US007322050B2

(12) United States Patent
Heatherly

(10) Patent No.: US 7,322,050 B2
(45) Date of Patent: Jan. 29, 2008

(54) WEARABLE GRIPPING DEVICE

(76) Inventor: Henry L. Heatherly, 4190 NW. 153 Ct., Cheifland, FL (US) 32626

( * ) Notice: Subject to any disclaimer, the term of this patent is extended or adjusted under 35 U.S.C. 154(b) by 0 days.

(21) Appl. No.: 11/207,023

(22) Filed: Aug. 18, 2005

(65) Prior Publication Data

US 2007/0050891 A1 Mar. 8, 2007

(51) Int. Cl.
*A41D 27/08* (2006.01)
*A41B 1/00* (2006.01)
*A41B 1/08* (2006.01)

(52) U.S. Cl. ..... 2/244; 2/115; 2/122

(58) Field of Classification Search ..... 2/122, 2/312, 337, 258, 260, 244, 2.15, 2.16, 115
See application file for complete search history.

(56) References Cited

U.S. PATENT DOCUMENTS 192,760 A * 7/1877 Hale ..... 81/3.4
1,386,777 A * 8/1921 George ..... 604/399
1,482,777 A * 2/1924 Becton ..... 2/24
1,877,527 A * 9/1932 Moran ..... 264/293
1,967,369 A * 7/1934 Repitsky ..... 2/48
1,997,703 A * 4/1935 Stepanian ..... 2/115
2,520,227 A * 8/1950 Taber ..... 2/123
2,570,848 A * 10/1951 Ozenberger ..... 2/48
3,076,201 A * 2/1963 Winter ..... 2/237
3,174,156 A * 3/1965 Dale et al. ..... 2/115
4,007,835 A * 2/1977 Klothe ..... 206/411
4,146,934 A * 4/1979 Cohen ..... 2/127
4,235,356 A * 11/1980 Atchisson ..... 224/192
4,369,526 A * 1/1983 Clutts ..... 2/51
4,754,499 A * 7/1988 Pirie ..... 2/20
4,805,238 A 2/1989 Crafts
4,894,866 A * 1/1990 Walker ..... 2/161.6
5,029,344 A * 7/1991 Shannon et al. ..... 2/69
5,097,566 A * 3/1992 Decker et al. ..... 16/421
5,133,233 A 7/1992 Erwin
5,276,922 A 1/1994 Floyd, Jr.
5,640,715 A * 6/1997 Adams ..... 2/46
5,770,297 A * 6/1998 Grubich ..... 428/99
5,787,511 A * 8/1998 Garside ..... 2/269
5,791,538 A * 8/1998 Bain, III ..... 224/663
5,878,439 A * 3/1999 Waters, Jr. ..... 2/161.6
6,098,497 A 8/2000 Larose
6,353,935 B1 * 3/2002 Antonini ..... 2/115
6,389,600 B1 * 5/2002 Di Maio ..... 2/121
6,622,312 B2 * 9/2003 Rabinowicz ..... 2/401
6,675,392 B2 * 1/2004 Albert ..... 2/161.1
6,700,031 B1 * 3/2004 Hahn ..... 602/41
6,742,414 B1 6/2004 Brailsford et al.
6,797,352 B2 * 9/2004 Fowler ..... 428/57
2002/0069446 A1 * 6/2002 Pinckney et al. ..... 2/49.1

(Continued)

FOREIGN PATENT DOCUMENTS

AU A-27177/95 * 9/1996

*Primary Examiner*—Alissa Hoey
*Assistant Examiner*—Jena A Sold
(74) *Attorney, Agent, or Firm*—J. Wiley Horton

(57) ABSTRACT

A gripping device attached to the shirt tail of a wearer which can be used for gripping objects. The gripping device is preferably constructed of leather, canvas, thick cotton or some other durable material. The gripping device can be used to open bottles and jars or it can be used in other gripping applications.

14 Claims, 8 Drawing Sheets

U.S. PATENT DOCUMENTS

2002/0069450 A1* 6/2002 McNamara ..... 2/244
2003/0075258 A1* 4/2003 Zhang et al. ..... 156/93
2004/0261152 A1* 12/2004 Mottl ..... 2/50
2005/0114978 A1* 6/2005 Benini ..... 2/69
2006/0048266 A1* 3/2006 Kim ..... 2/117
2006/0053526 A1* 3/2006 Beland et al. ..... 2/115
2006/0150298 A1* 7/2006 Jones ..... 2/93

* cited by examiner

WEARABLE GRIPPING DEVICE

BACKGROUND OF THE INVENTION

1. Field of the Invention.

This invention relates to the field of clothing accessories. More specifically, this invention comprises a gripping device worn on a wearer's shirt to provide the wearer with assistance when gripping objects.

2. Description of the Related Art.

Various accessories have been created that are worn by a wearer in order to assist the wearer in gripping various objects. Gloves are one example of this type of accessory. Various types of gloves exist to serve various applications. One common type of glove is a work glove. Work gloves are designed principally to protect the wearer's hands while the wearer is engaged in handling rough objects. Work gloves are commonly made of leather, canvas, or some other durable material.

Bartending gloves and gloves for opening bottles are examples of gloves designed for specific gripping applications. These gloves are designed specifically for gripping bottle tops in order to remove the bottle top from the bottle. U.S. Pat. No. 4,805,238 to Crafts; U.S. Pat. No. 4,894,866 to Walker; U.S. Pat. No. 5,133,233 to Erwin; and U.S. Pat. No. 5,276,922 to Floyd, Jr. are examples of gloves designed for this application.

Other accessories have been designed to be worn by a wearer for opening bottles and containers besides gloves. One example is an opener designed to be worn as a ring on the wearer's finger. An example of a ring opener is described in U.S. Pat. No. 6,742,414 B1 to Brailsford et al. Another example is a gripping device worn between a wearer's thumb and index finger. An example of such a gripping device is described in U.S. Pat. No. 5,770,297 to Grubich. Still another example is a bottle opening device designed to be worn on the wearer's wrist like a wrist watch. An example of this type of bottle opening devices is described in U.S. Pat. No. 6,098,497 to Larose.

These gripping assistive devices have their drawbacks, however. Devices worn on or around the wearer's hands often get in the way or are uncomfortable when they are not in use. Furthermore, removing these devices defeats their purpose in that the purpose of wearing these gripping assistive devices is for the devices to be ready and available for use when needed.

It is therefore desirable to provide a gripping assistive device that is convenient and easy to use but does not get in the user's way when not in use.

BRIEF SUMMARY OF THE INVENTION

The present invention is a gripping device attached to the shirt tail of a wearer which can be used for gripping objects. The gripping device is preferably constructed of leather, canvas, thick cotton or some other durable material. The gripping device can be used to open bottles and jars or it can be used in other gripping applications.

REFERENCE NUMERALS IN THE DRAWINGS

| | | | |
|---|---|---|---|
| 10 | shirt | 12 | gripping device |
| 14 | stitching | 16 | grasping side |
| 18 | gripping side | 20 | shirt tail |
| 22 | bottle cap | 24 | bottle |
| 26 | hand | 28 | bumps |
| 30 | inside of loop | 32 | stitching |
| 34 | stitching | 36 | centerline |

DETAILED DESCRIPTION OF THE INVENTION

Figure 1:
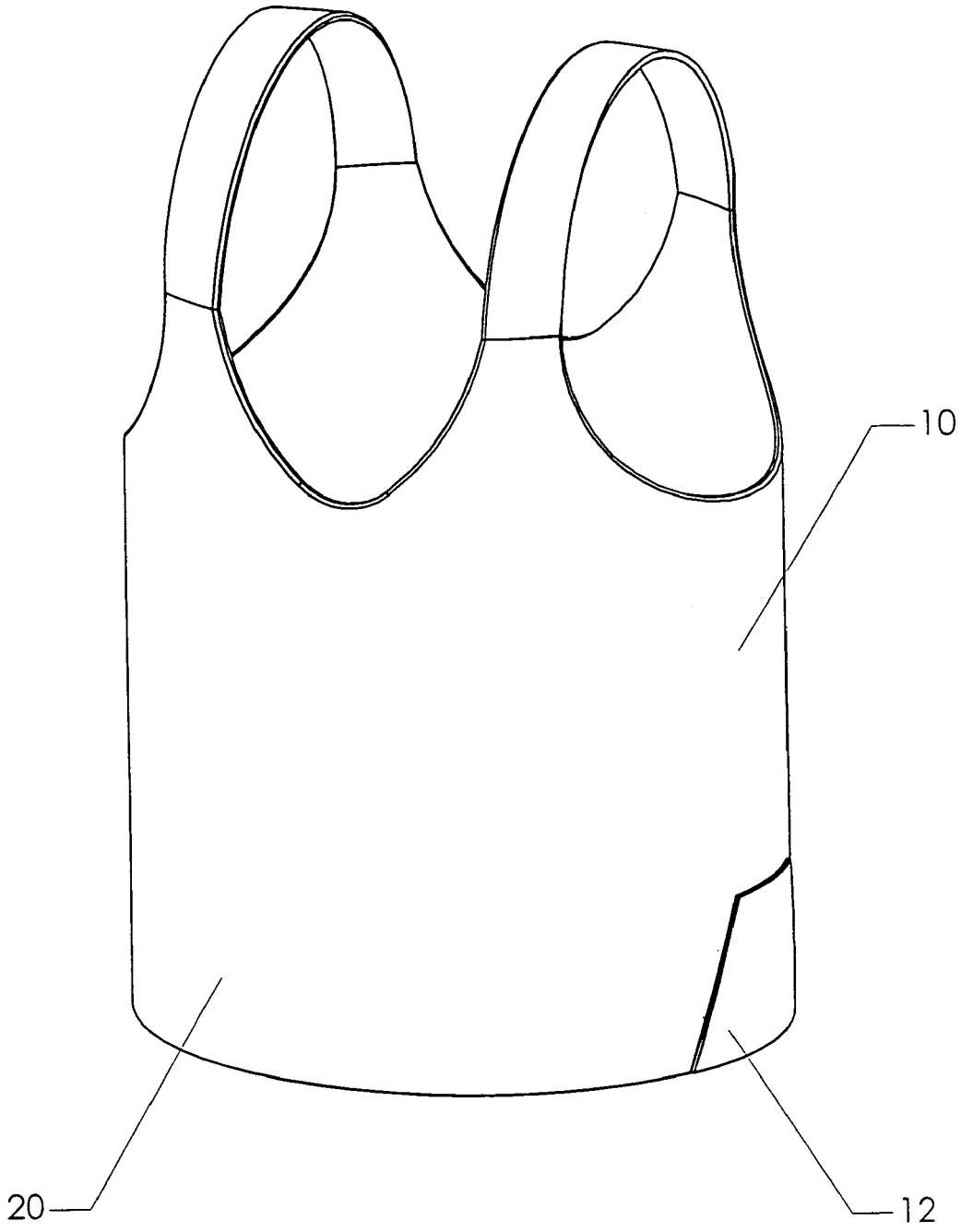
FIG. 1 is a perspective view, showing the present invention.

The present invention, gripping device 12, is shown in FIG. 1. Shirt 10 is provided with shirt tail 20. Although shirt 10 is illustrated as a sleeveless tee shirt in FIG. 1, it is understood that shirt 10 can be other articles of clothing. Shirt 10 can be any type of shirt, sweater, sweatshirt, jacket or the like. Gripping device 12 is attached to shirt tail 20 as will be described subsequently. Shirt tail 20 is the lowest part of shirt 10 and extends all the way around the wearer's body. Although the invention is illustrated on the side of the wearer in FIG. 1, it is understood that gripping device 12 can also be placed in the front or back. Also, any number of gripping devices 12 can be provided. In the preferred embodiment, two gripping devices 12 are attached to shirt tail 20—one on the left side of the wearer and one on the right side of the wearer.

Figure 2:
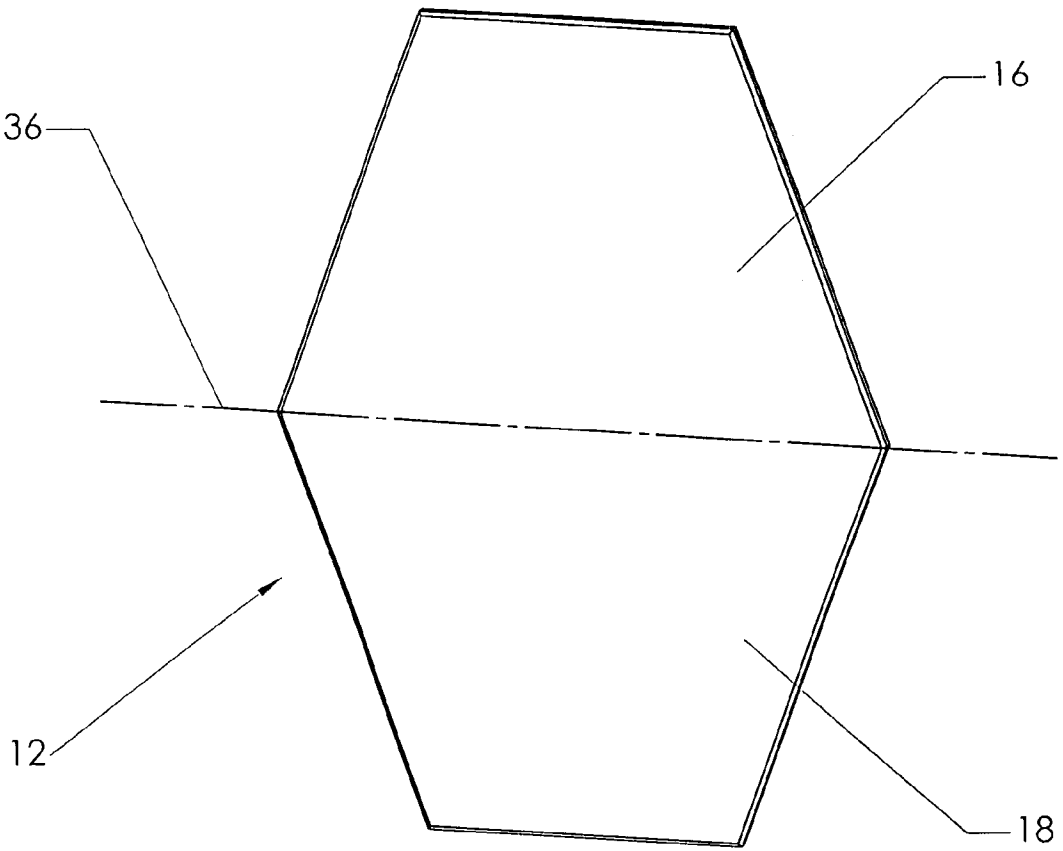
FIG. 2 is a perspective view, showing the present invention.
Figure 3:
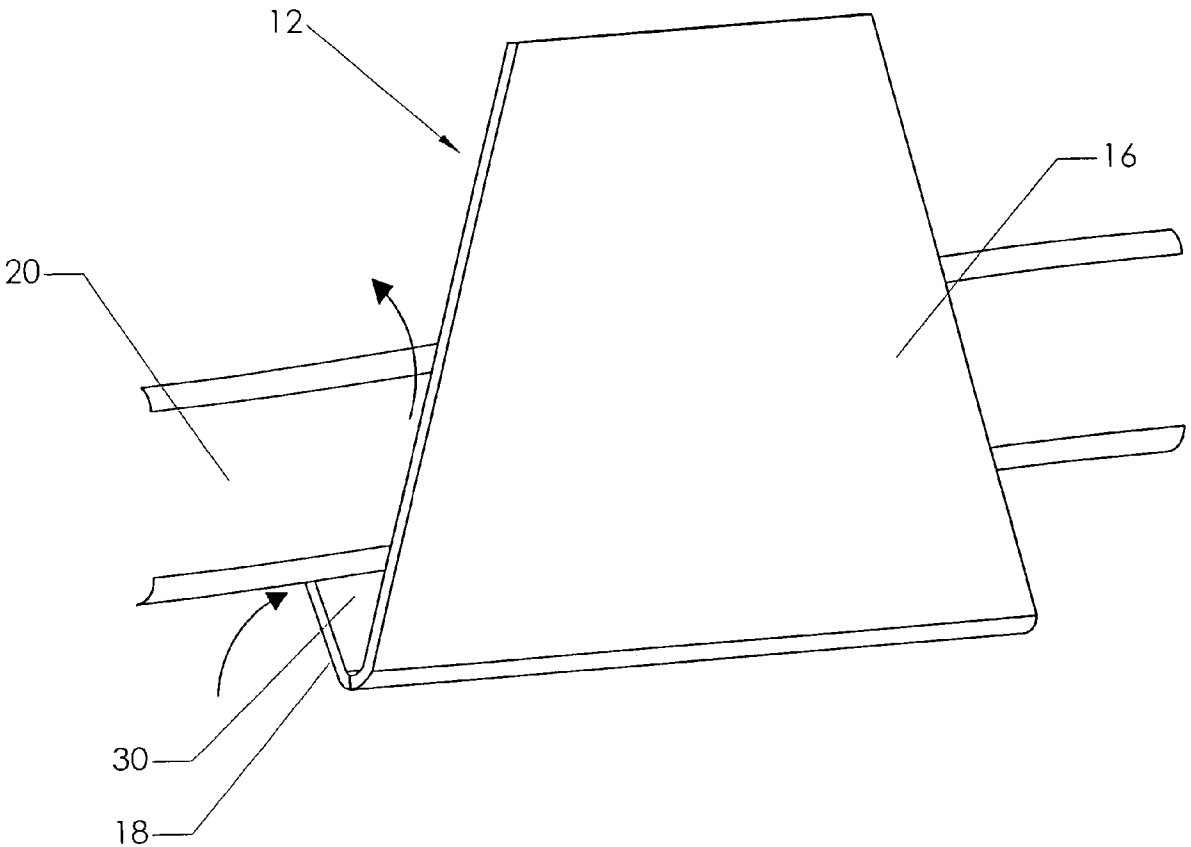
FIG. 3 is a perspective view, showing a way to manufacture the present invention.

Gripping device 12 is shown detached from shirt 10 for illustration purposes in FIG. 2. The viewer will note that in the preferred embodiment of the present invention, gripping device 12 is a hexagonal flap of material. Centerline 36 divides gripping device 12 into two sides—gripping side 18 and grasping side 16. Gripping side 18 is substantially symmetrical to grasping side 16 about centerline 36. Although one side is designated gripping side 18 and the other side is designated grasping side 16, either side can be used for grasping or gripping as will be explained later. As shown in FIG. 3, gripping device 12 is folded along centerline 36 and is wrapped around shirt tail 20 so that gripping side 18 is on the inside of shirt tail 20 and grasping side 16 is on the outside of shirt tail 20. When attached in this manner, centerline 36 runs substantially parallel to the bottom of shirt tail 20. The viewer will also note that when attaching gripping device 12 in this manner, gripping device 12 generally forms a loop with inside of loop 30 facing the inside and outside of shirt tail 20.

Figure 4:
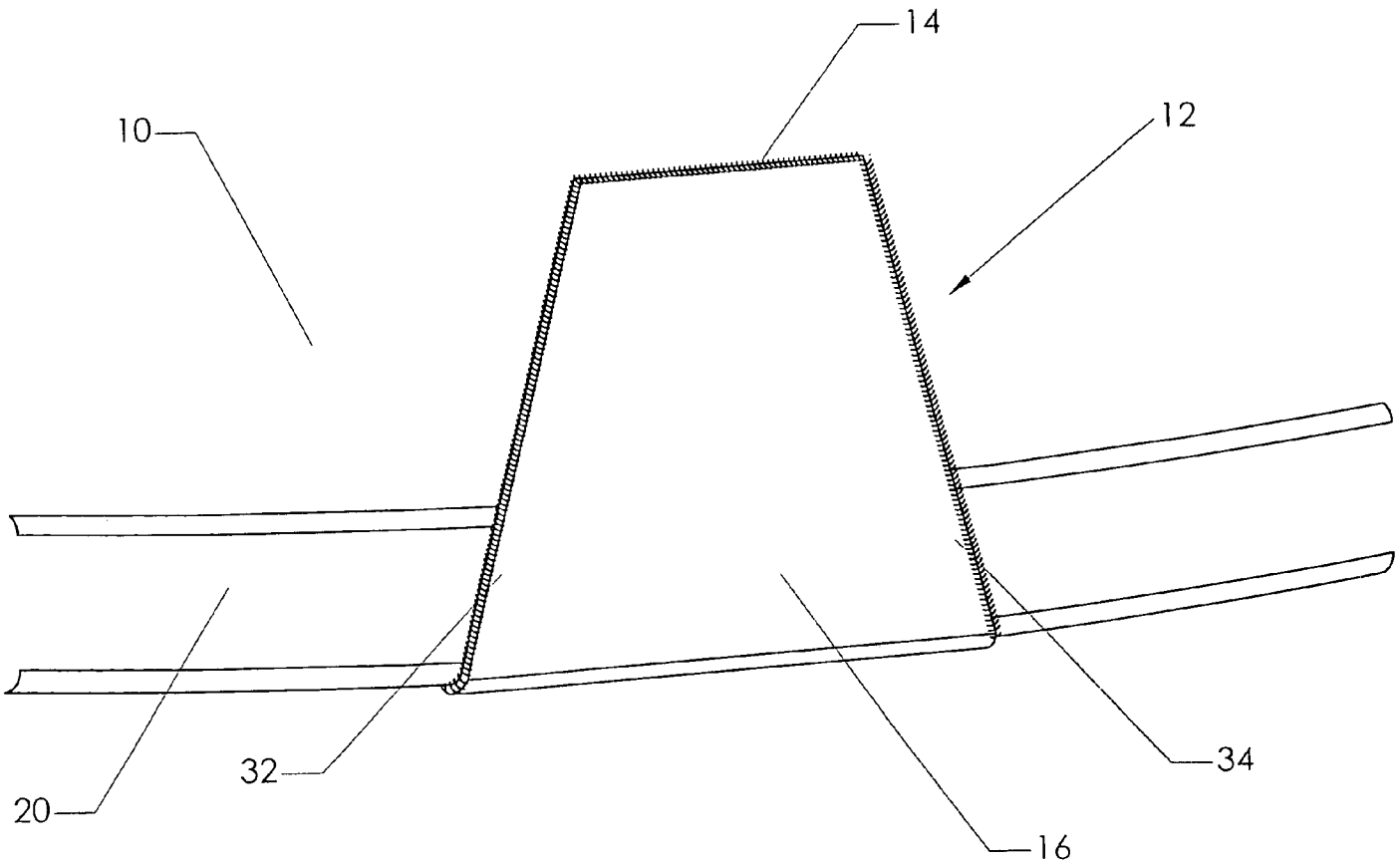
FIG. 4 is a perspective view, showing the present invention

A detailed illustration of the present invention is provided in FIG. 4. Gripping device 12 is generally a strip of material attached around shirt tail 20. Gripping device 12 is preferably made of a durable material since gripping device 12 may be used to assist the wearer in gripping rough objects. Examples of suitable durable materials for gripping device 12 include leather, suede, rubber, rubber-like materials, canvas, denim, and other durable weaves of cotton.

One end of gripping device 12 is stitched on the outside of shirt 10 with stitchings 14, 32, and 34. The other end (not shown) is stitched on the inside of shirt 10 so that the medial section between the ends of gripping device 12 wraps around shirt tail 20 forming a loop. In the preferred embodiment stitching 32 is provided along the left side of gripping device 12, stitching 34 is provided along the right side of gripping device 12, and stitching 14 is provided along the top side of gripping device 12. Although gripping device 12 is illustrated as being attached to shirt 10 with stitchings 14, 32 and 34, any attachment mechanism known in the art can also be used. Other attachment mechanisms that can be used include but are not limited to glues, adhesive tapes, snaps, zippers, and buttons.

The reader will appreciate that this construction method creates three layers of material. Grasping side 16 and gripping side 18 are sandwiched around shirt tail 20. This layering effect makes gripping device 12 more durable and comfortable to use.

Figure 5:
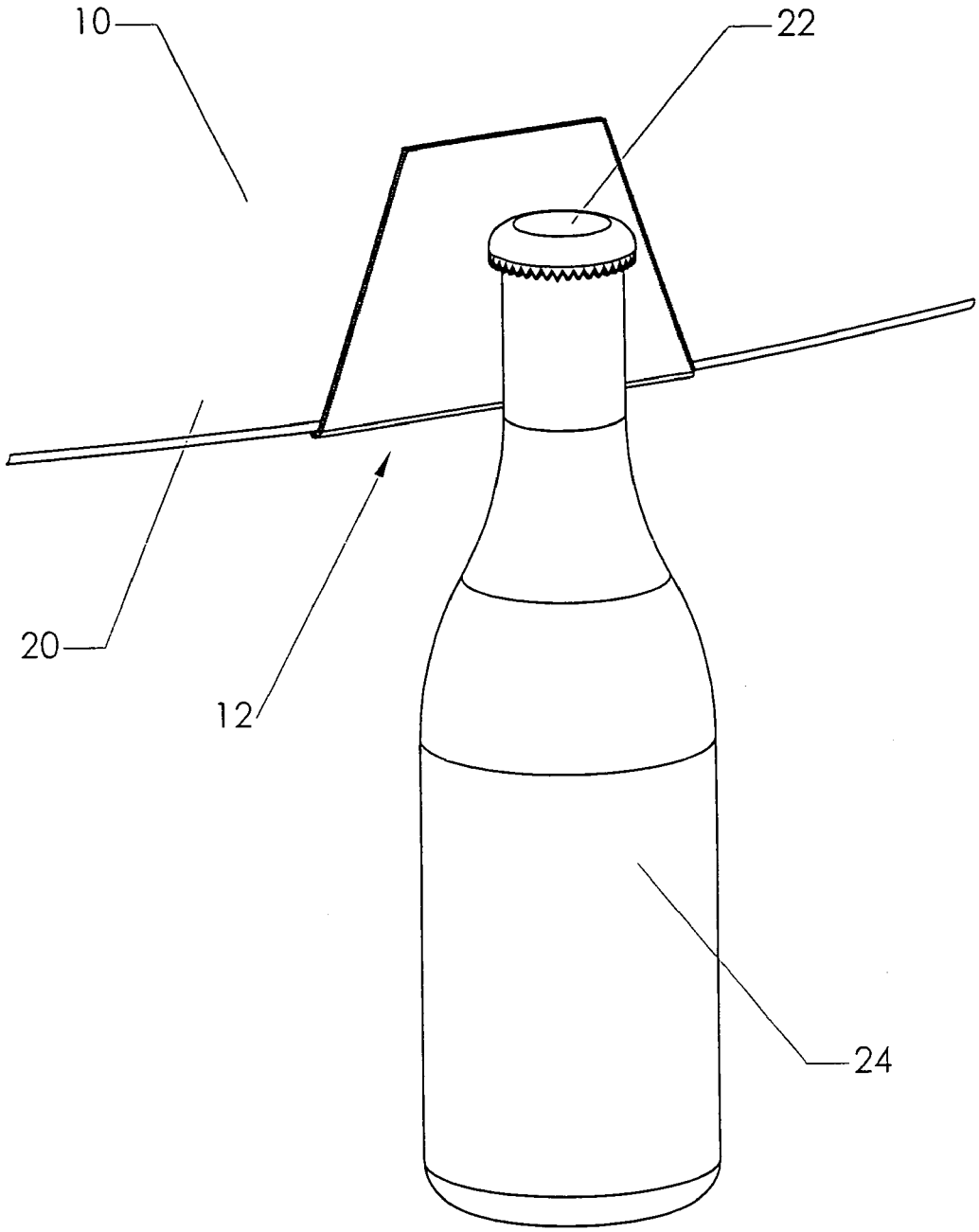
FIG. 5 is a perspective view, showing the present invention in use.
Figure 6:
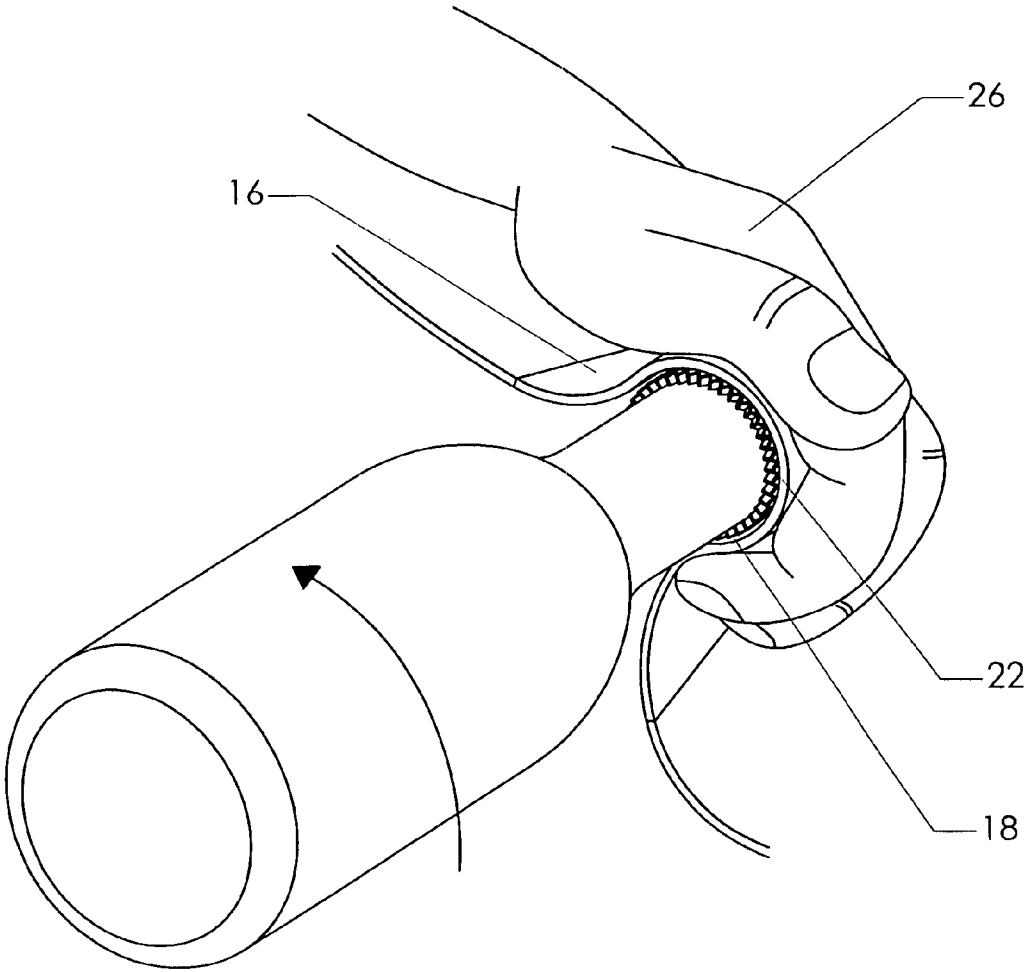
FIG. 6 is a perspective view, showing the present invention in use.

Gripping device 12 can be used for many different gripping applications. One such application—opening a twist-top bottle—is illustrated in FIGS. 5 and 6. As illustrated in FIG. 5, bottle cap 22 of bottle 24 is first placed next to gripping device 12 inside shirt tail 20. As illustrated in FIG. 6, the wearer then grasps grasping side 16 of gripping device 12 with hand 26 so that gripping side 18 is compressed around bottle cap 22. The reader will appreciate that gripping side 18 forms intimate and tight contact around bottle 24 when grasped in this manner. The wearer then turns bottle 24 as shown to remove bottle cap 22 from bottle 24.

Figure 8:
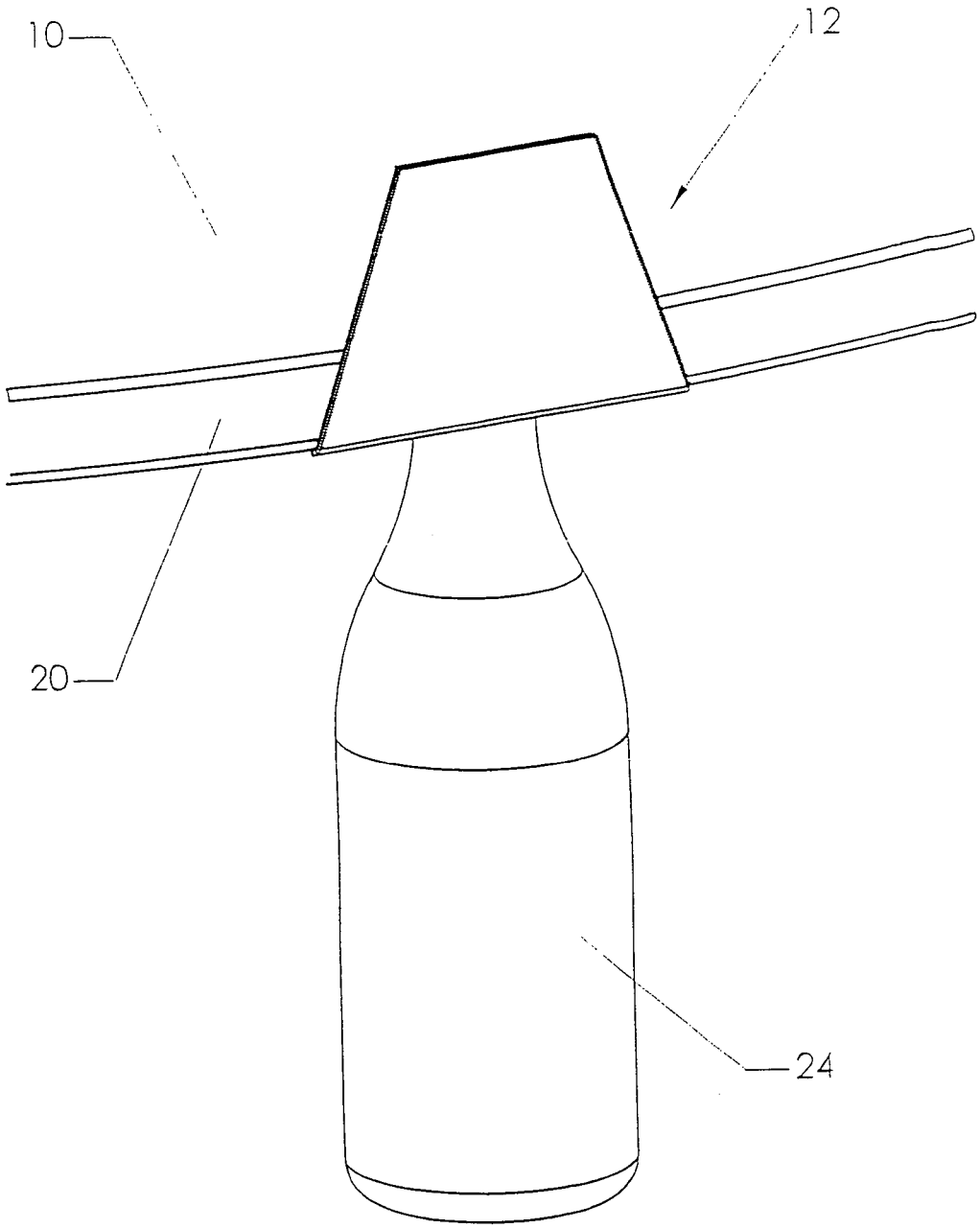
FIG. 8 is a perspective view, showing the present invention in use.

Although grasping side 16 is illustrated on the outside of shirt tail 20 and gripping side 18 is shown on the inside of shirt tail 20, the reader will appreciate that either side can be used for gripping or grasping. For example, —as illustrated in FIG. 8 the user may also, place the bottle on grasping side 16 (the designation for the side of gripping device 12 on the outside of shirt tail 20) and grasp the bottle cap with gripping side 18 (the designation for the side of gripping device 12 on the inside of shirt tail 20). The invention works the same either way.

Gripping device 12 can obviously be used to grip other items besides bottle caps. Gripping device 12 can be used in the same manner to remove lids from jars. It can also be used in any circumstances where the wearer needs gripping assistance. Since gripping device 12 is provided on shirt 10, the wearer will benefit from having a gripping assistive device for any gripping need that may arise while the wearer is wearing shirt 10.

Figure 7:
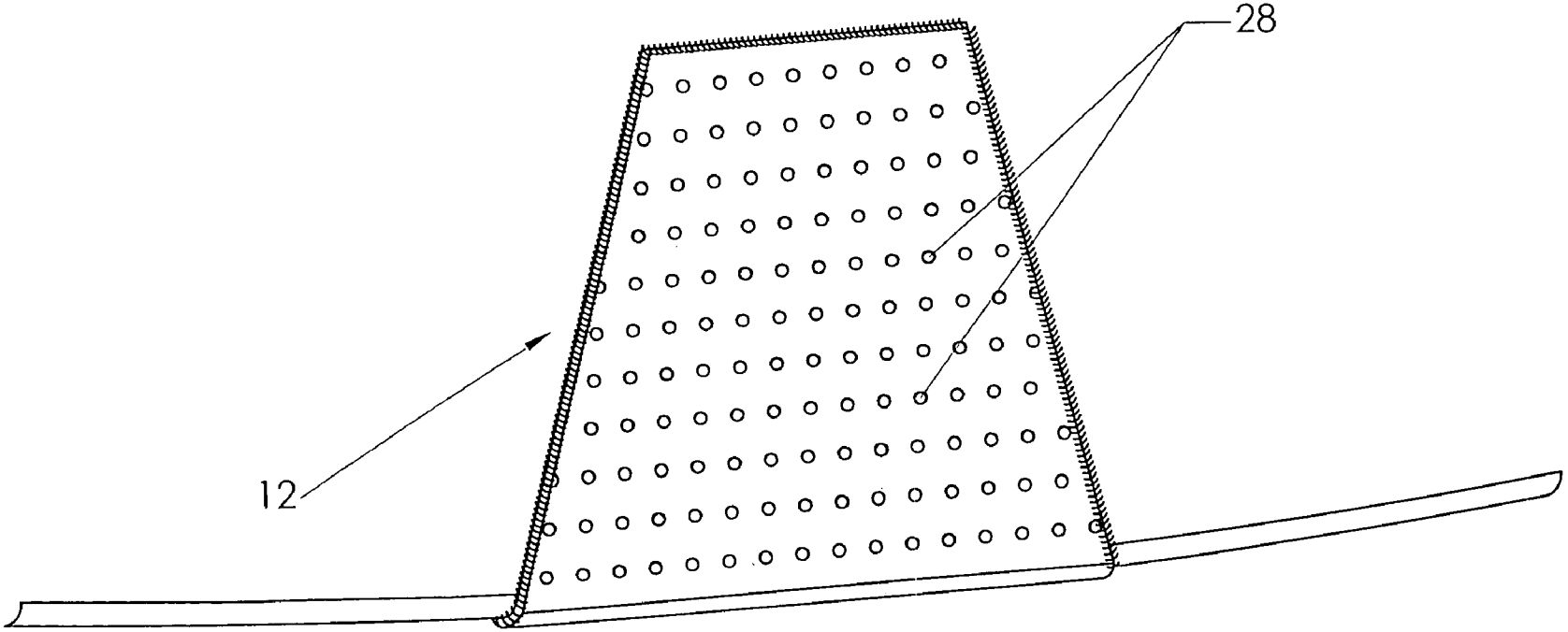
FIG. 7 is a perspective view, showing an alternate embodiment of the present invention

Additional gripping features can also be provided to the gripping side of gripping device 12, as shown in FIG. 7 to improve the effectiveness of the gripping assistive device. For example, molded rubber bumps 28 can be provided along grasping side 16 or gripping side 18. Bumps 28 provide added texture to gripping device 12 for improved grip. Although molded rubber bumps 28 are shown, other textural variations, such as ridges, can be provided on gripping device 12 to accomplish the same goal.

The preceding description contains significant detail regarding the novel aspects of the present invention. It should not be construed, however, as limiting the scope of the invention but rather as providing illustrations of the preferred embodiments of the invention. As an example, gripping device 12 can be made in various shapes and sizes to be more convenient for specific gripping applications. Gripping device 12 can even be wrapped around the entirety of shirt tail 20. Such a variation would not alter the function of the invention. Thus, the scope of the invention should be fixed by the following claims, rather than by the examples given.

Having described my invention, I claim:

1. A wearable gripping device for gripping objects, such as when removing a bottle cap from a neck of a bottle, said bottle cap having a top and perimeter, said wearable gripping device being attached to a wearer's shirt, said wearer having a hand, said shirt having a shirt tail with an inside, an outside, and a bottom, said wearable gripping device comprising:

a. a flap, said flap having a grasping side, a gripping side, a first end, a second end, and a medial section therebetween; and b. wherein said first end of said flap is stitched to said shirt on said outside of said shirt tail, said medial section of said flap wraps around said bottom of said shirt tail, and said second end of said flap is stitched to said shirt on said inside of said shirt tail, such that said grasping side, said shirt tail, and said shirt tail together form a construction of at least three layers;

c. wherein said flap is sufficiently sized and configured to cover the entirety of said bottle cap and a portion of said neck of said bottle, such that said flap makes intimate contact with both said top and said perimeter when said bottle cap and said portion of said neck of said bottle is placed against said gripping side of said flap and said wearer grasps said grasping side of flap with said hand regardless of the direction said bottle is angled with respect to said flap; and d. wherein said flap includes molded rubber bumps as a textual variation for improved gripping.

2. The wearable gripping device of claim 1, wherein said flap is made of a durable material.

3. The wearable gripping device of claim 2, wherein said durable material is selected from a group consisting of:

a. leather;

b. suede;

c. canvas;

d. denim; and e. rubber.

4. The wearable gripping device of claim 1, wherein said flap includes a first edge and a second edge, said first edge and said second edge extending between said first end and said second end; and wherein said flap is stitched to said shirt tail along said first edge and said second edge.

5. A wearable gripping device for gripping objects, such as when removing a bottle cap from a bottle, said bottle cap having a top and perimeter, said wearable gripping device being attached to a wearer's shirt, said wearer having a hand, said shirt having a shirt tail with an inside, an outside, and a bottom, said wearable gripping device comprising:

a. a flap, said flap having a first end, a second end, a first edge, a second edge, and a centerline, said first edge and said second edge extending between said first end and said second end, said centerline dividing said flap into a grasping side proximal said first end and a gripping side proximal said second end;

b. wherein said first end of said flap attaches to said shirt on said outside of said shirt tail and said of said flap attaches to said shirt on said inside of said shirt tail, and said centerline runs substantially parallel to said bottom of said shirt tail, wherein said flap is stitched to said shirt tail along said first edge and said second edge; and c. wherein said flap is sufficiently sized and configured to cover the entirety of said bottle cap and a portion of said neck of said bottle, such that said flap makes intimate contact with both said top and said perimeter when said bottle cap and said portion of said neck of said bottle is placed against said gripping side of said flap and said wearer grasps said grasping side of flap with said hand regardless of the direction said bottle is angled with respect to said flap; and d. wherein said first edge and said second edge bound said flap such that said flap covers only a portion of said shirt tail, thereby leaving a first portion of said shirt tail adjacent to said first edge and a second portion of said shirt tail adjacent to said second edge exposed and uncovered by said flap.

6. The wearable gripping device of claim 5, wherein said flap is made of a durable material.

7. The wearable gripping device of claim 6, wherein said durable material is selected from a group consisting of:

a. leather;

b. suede;

c. canvas;

d. denim; and e. rubber.

8. The wearable gripping device of claim 7, where said flap includes textural variation for improved gripping.

9. The wearable gripping device of claim 8, where said textural variation includes molded rubber bumps.

10. The wearable gripping device of claim 6, where said flap includes textural variation for improved gripping.

11. The wearable gripping device of claim 10, where said textural variation includes molded rubber bumps.

12. The wearable gripping device of claim 5, where said flap includes textural variation for improved gripping.

13. The wearable gripping device of claim 12, where said textural variation includes molded rubber bumps.

14. The wearable gripping device of claim 5, wherein said flap is attached to said shirt tail in such a manner that said grasping side, said shirt tail, and said shirt tail together form a construction of at least three layers.

* * * * *